US006560925B1

(12) United States Patent
Rice

(10) Patent No.: US 6,560,925 B1
(45) **Date of Patent: *May 13, 2003**

(54) DOOR SECURITY DEVICE WITH GLUE ON ATTACHMENT

(75) Inventor: Brian J. Rice, Columbia City, IN (US)

(73) Assignee: Access Denied, Inc., Columbia City, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/837,668

(22) Filed: Apr. 22, 1997

Related U.S. Application Data

(63) Continuation-in-part of application No. 08/525,392, filed on Sep. 8, 1995, now Pat. No. 5,622,397, which is a continuation-in-part of application No. 08/127,301, filed on Sep. 24, 1993, now Pat. No. 5,496,081, which is a continuation-in-part of application No. 08/045,363, filed on Apr. 8, 1993, now Pat. No. 5,364,140.

(51) Int. Cl.[7] ..... E05C 19/18

(52) U.S. Cl. ..... 49/141; 292/92; 292/259 R; 292/288

(58) Field of Search ..... 49/141, 503, 465, 49/57, 62; 292/289, 288, 259 R, 338, 339; 70/94, 92, 91

(56) References Cited

U.S. PATENT DOCUMENTS

| | | | | | |
|---|---|---|---|---|---|
| 2,449,384 | A | * | 9/1948 | Hursey et al. | 49/366 |
| 2,992,819 | A | * | 7/1961 | Jackson | 49/199 |
| 3,819,216 | A | | 6/1974 | Richardson | |
| 3,863,968 | A | | 2/1975 | Fraser | |
| 3,999,790 | A | | 12/1976 | Rogen | |
| 4,082,332 | A | | 4/1978 | Palmer | |
| 4,311,225 | A | * | 1/1982 | Tsubaki et al. | 49/199 |
| 4,601,503 | A | | 7/1986 | Wicks, Sr. | |
| 4,644,696 | A | * | 2/1987 | Bursk | 49/367 |
| 4,756,052 | A | | 7/1988 | Diedrich | |
| 4,765,093 | A | * | 8/1988 | Edwards, Jr. | 49/199 |
| 4,856,831 | A | | 8/1989 | Roden, Jr. | |
| 4,891,908 | A | * | 1/1990 | Aquilina | 49/199 |
| 4,927,193 | A | | 5/1990 | Miller | |
| 5,077,940 | A | | 1/1992 | LaRose, Jr. | |
| 5,253,905 | A | | 10/1993 | Hutson | |
| 5,364,140 | A | | 11/1994 | Rice | |
| 5,388,876 | A | * | 2/1995 | Saincome | 292/288 |
| 5,462,321 | A | * | 10/1995 | Osborn | 292/288 |
| 5,490,696 | A | | 2/1996 | Hutson | 292/259 R X |
| 5,496,081 | A | | 3/1996 | Rice | 292/259 R |
| 5,622,397 | A | * | 4/1997 | Rice et al. | 292/288 |

* cited by examiner

*Primary Examiner*—Daniel P. Stodola
(74) *Attorney, Agent, or Firm*—Barnes & Thornburg

(57) ABSTRACT

A security device for one or more doors or windows which includes an elongated support bar, an attachment mechanism mounted to the support bar, at least one receiving member attached to a structure to which the security device is to be positioned adjacent, at least one blocking member attached to the support bar, and an actuator mechanism. The at least one receiving member is surface mounted to the structure by an adhesive, glue, or cement.

18 Claims, 15 Drawing Sheets

DOOR SECURITY DEVICE WITH GLUE ON ATTACHMENT

RELATED APPLICATIONS

This application is a continuation-in-part of application Ser. No. 08/525,392, filed on Sep. 8, 1995, now U.S. Pat. No. 5,622,397 which is a continuation-in-part of application Ser. No. 08/127,301, filed on Sep. 24, 1993, now U.S. Pat. No. 5,496,081 which is a continuation-in-part of application Ser. No. 08/045,363, filed on Apr. 8, 1993, now U.S. Pat. No. 5,364,140.

BACKGROUND AND SUMMARY OF THE INVENTION

The present invention relates generally to door security devices. More particularly, the present invention relates to devices which mechanically prevent a door from being opened.

One-way doors, that is, doors that open by swinging in only one direction, are especially popular in commercial buildings, schools, and the like. They provide easy ingress and egress to and from buildings. Out-swinging doors in schools and commercial buildings are often equipped with panic-bar handles. A panic-bar handle may include an elongated rod extending across the width of the door. By pushing against the rod, the door latch is released and the door may be opened. If a crowd of people are pushed up against the door, the weight of the crowd will depress the rod and the door will open. Similarly, if a person is in a hurry to open the door, the person need not stop to turn a conventional doorknob to unlatch the door. The person need only exert a force on the rod and the door will open.

One-way doors are also targets for burglars. Doors which open in an outward fashion can often be readily opened, even if locked. A pry bar or similar tool can be wedged between the door and the door frame, and the door can be pried open.

Thus, while the safety features of the out-swinging panic-bar door are desirable, the ease with which these doors may be broken into is a disadvantage. To reduce the threat of burglary, devices have been made which prevent out-swinging doors from being opened.

Devices are known which are permanently or semi-permanently attached to the door or door frame. For example, a support bar may be bolted to the door, across the door frame, preventing the door from being opened. Such an arrangement is shown in U.S. Pat. No. 4,856,831, issued to Roden, Jr. This type of arrangement, however, defeats the purpose of the panic-bar handle arrangement. If, under exigent circumstances, the door must be quickly opened, the permanent security device can not be readily removed, and the door cannot be quickly opened.

Another drawback of known security devices is that many require additional hardware to be mounted to the door or door frame. This can require special tooling. Furthermore, it can be difficult and time consuming to mount these devices. Such devices may also leave permanent marks or otherwise deface the door once the devices have been removed.

Known security devices are also limited in that they can typically be used with only a particular door. Once the necessary hardware is attached to the door or door frame, the security device can only be used on that particular door. To use the security device on another door, the hardware must be removed from the first door and placed on the second door.

The present invention provides a door security device which is secured to the inside of an out-swinging door. The security device generally includes an elongate support bar having first and second ends, the length of which typically exceeds a width of the door. Typically, the security device of the present invention is positioned in a substantially horizontal orientation such that the first and second ends of the support bar are disposed adjacent opposing vertical members of the door frame.

Attached to the first and second ends of the support bar are blocking members. The blocking members are designed to be positionable against the door frame. Each blocking member includes a surface thereon for contacting and resting against the door frame. Each blocking member also includes an adjustment mechanism which provides for adjustable positioning of the support bar with respect to the blocking member. In the illustrative embodiments shown, the adjustment mechanism includes a slot located within the blocking member. The slot is disposed substantially orthogonally to-the longitudinal axis of the support bar, such that the support bar may translate within the slot parallel to the longitudinal axis of the slot. The adjustment mechanism also includes a threaded member which engages the blocking member and the support bar. The threaded member includes a knob or head, such that turning or actuating the knob causes the support bar to move within the slot relative to the blocking member.

The door security device of the present invention also includes an attachment means, which allows the device to removably engage a portion of a door. One illustrative embodiment of the attachment means includes a pair of generally J-shaped hooks. The hooks include an engagement portion and a generally elongate stem. The stem is disposed substantially through the support bar, and extends substantially orthogonally therefrom. The engagement portion of the hook is opposite the support bar, and is designed to engage a portion of the door. As the handle assembly is actuated, the engagement portion of the hook is drawn near the support bar, thereby exerting a force on a portion of the door.

The present invention also includes an actuation mechanism. In the illustrative embodiment shown, the actuation mechanism includes a handle assembly. The handle assembly includes a generally elongate rod disposed substantially parallel to the support bar, and spaced apart from the support bar. At opposite ends of the rod are elbow members which terminate adjacent the support bar. The elbow members are pivotally connected to the hooks. A pin connecting the elbow to the hook acts as a pivot point, allowing the elbow and thus the handle assembly to pivot with respect to the hook, and the support bar.

The security device of the present invention further includes a spring mechanism which provides tension against the handle assembly when the handle is actuated. The spring mechanism includes a washer which is attached to the hooks and a coil spring which is disposed about the hooks between the washer and the support bar.

The present invention also includes a camming surface which contacts a substrate to lock the device in place. Typically the substrate will be the support bar. In one illustrative embodiment, the camming surface pivots in response to actuation of the handle assembly. In this embodiment, the camming surface is located on the elbow member of the handle assembly. The point of pivotal connection between the elbows of the handle assembly and the hooks forms the pivot point for the camming surface.

The camming surface includes a first surface, a second angled surface, and a third surface. In the illustrative embodiments shown, the first surface and third surface are disposed substantially orthogonal to one another, and the angled surface connects the first surface to the third surface. In the embodiments shown, the angled surface extends at an angle approximately 45° from the horizontal. As illustratively shown, the distance between the pivot point and the first surface is less than the distance between the pivot point and the angled surface, and the distance between the pivot point and the angled surface is less than the distance between the pivot point and the third surface. Thus, as the handle assembly is pivoted, the camming surface pivots about the pivot point, and the first surface, second angled surface, and third surface, in turn, contact the support bar.

In some instances, it may be desirable to coat portions or all of the security device. For example, it may be desirable to paint portions of the security device for aesthetic reasons. Also, it may be desirable to coat portions of the security device such that it does not scratch or cause damage to the door or door frame. Thus, portions of the blocking members and attachment means may be coated with a non-abrasive substance, so as not to scratch or cause damage to the door.

In an alternative embodiment of the invention, the door security device is adapted to be secured to the inside of an in-swinging door. The principals of operation of this alternative embodiment are essentially the same as in the case of the out-swinging door.

Another embodiment of a security device of the present invention includes a support bar, at least one blocking means, attaching means, and an actuator. The support bar has first and second ends and the blocking means is disposed between the ends of the support bar. The attaching means is mounted to the support bar for removable securing the support bar in position adjacent a structure. The actuator is connected to the attaching means and is operable to actuate the attaching means to secure the support bar adjacent the structure.

The attaching means may include a first attaching mechanism at the first end of the support bar and a second attaching mechanism at the second end of the support bar. A spring mechanism may be attached to the device adjacent each one of the first and second attaching mechanisms. The spring mechanisms provide tension against the actuator. Each spring mechanism may include a washer secured to either the first or second attaching mechanism and a spring disposed about that attaching mechanism between the washer and the support bar.

The attaching means may be coupled to the structure to secure the support bar adjacent the structure.

The security device may additionally include receiving means and the structure may include a pair of doors to which the receiving means is attached. The attaching means engages the receiving means and the blocking means engages the doors to secure the support bar adjacent the doors. The blocking means may include either a single blocking member that engages both doors or a pair of blocking members each of which engages one of the doors.

Alternatively, the structure may include a pair of doors each of which includes a handle assembly. In this arrangement, the attaching means engages the handle assemblies of the doors and the blocking means engages the doors to secure the support bar adjacent the doors. Again, as above, the blocking means may include either a single blocking member that engages both doors or a pair of blocking members each of which engages one of the doors.

In another application, the security device additionally includes receiving means and the structure includes a pair of doors separated by a mullion. The receiving means is attached to the doors, the attaching means engages the receiving means, and the blocking means engages the mullion to secure the support bar adjacent the doors. The blocking means includes at least one blocking member that engages the mullion.

In yet another application, the structure includes a pair of doors separated by a mullion and each door includes a handle assembly. In this application, the attaching means engages the handle assemblies and the blocking means engages the mullion to secure the support bar adjacent the doors. Again, the blocking means includes at least one blocking member that engages the mullion.

In still yet another application, the security device includes receiving means and the structure includes a pair of doors separated by a mullion. The receiving means is attached to the mullion, the attaching means engage the receiving means, and the blocking means engages the doors to secure the support bar adjacent the doors. In this application, the blocking means includes a pair of blocking members each of which engages one of the doors.

In a further application, the security device additionally includes receiving means and the structure includes a door and either a frame to which the door is attached or a wall adjacent the door. In this application, the receiving means is attached to the door and either the frame or the wall, the attaching means engages the receiving means, and the blocking means engages the door. The blocking means includes either a blocking member engaged with the door or a pair of blocking members one of which is engaged with the door and the other of which is engaged with either the frame or the wall.

In yet another application, the security device includes receiving means and the structure includes a door and either a frame to which the door is attached or a wall adjacent the door. In this application, the receiving means is attached to either the frame or the wall, the attaching means engages the receiving means, and the blocking means engages the door. The blocking means may include either a blocking member engaged with the door or a pair of blocking members one of which is engaged with the door and the other of which is engaged with the frame or the wall.

In still yet another application, the structure includes a door having a handle assembly and either a frame to which the door is attached or a wall adjacent the door. In this application, the attaching means engages the handle assembly and the blocking means engages either the frame or the wall. The security device may include receiving a means attached to either the frame or wall. The attaching means also engages this receiving means. The blocking means may include a blocking member.

In the above-described applications, the receiving means may include at least one eyelet, at least one attachment block, at least one opening in which the attaching means is disposed, or at least one hook-engaging structure. The receiving means or attachment block(s) may be mounted in any suitable manner to an appropriate structure as noted above, e.g., one or more doors, a mullion between two doors, a door frame and/or a wall adjacent a door. The receiving means or attachment block(s) can be secured to such structures by means of mechanical fasteners such as bolts, screws, weldments, etc., or by chemical means such as adhesives, glues, epoxies, cements, etc. The use of chemical means to secure the receiving means or attachment block(s)

is particularly suitable for use in conjunction with glass doors as discussed below. Using chemical means to secure the receiving means or attachment block(s) to wooden or wooden core doors will prevent compromising the fire-rating of such doors.

Although various structures have been enumerated above for which the security device of the present invention may be used, it is to be understood that these various structures are only examples of possible applications of the present invention. Other applications are possible. For example, the structure may include a window.

The security device may additionally include a camming surface on the actuator for contacting either the support bar or the blocking member during actuation of the attaching means, the camming surface pivoting in response to operation of the actuator. The camming surface may include a plurality of angled surfaces.

The actuator may include a rod spaced apart from the support bar and opposing elbow members connected to opposite ends of the rod and connected to the attachment means adjacent the support bar. The security device may additionally include a camming surface on each of the elbow members, adjacent either the support bar or the blocking means. Operation of the actuator may cause the attachment means to move away from the structure. The camming surface may include a plurality of angled surfaces and may pivot about a pivot point during operation of the actuator. In this embodiment, the attaching means moves away from the structure by a distance approximately equal to a difference between the pivot point about which the camming surface pivots upon operation of the actuator and a first surface of the camming surface, and the pivot point and a third surface of the camming surface.

The blocking means may include at least one blocking member having an adjustment mechanism for adjustably positioning the support bar with respect to the blocking member. The adjustment mechanism may include a slot within the blocking member, the slot being disposed substantially orthogonally to a longitudinal axis of the support bar such that the support bar may translate within the slot substantially parallel to a longitudinal axis of the slot. The adjustment mechanism may include a variable adjustment mechanism, whereby actuation of the variable adjustment mechanism causes the support bar to move within the slot relative to the blocking member. The variable adjustment mechanism may include a threaded member engageable with the blocking member and the support bar that may be actuated to cause the support bar to move within the slot relative to the blocking member.

The attachment means may include at least one hook extending substantially through the support bar. This hook includes an engagement portion disposed opposite the support bar configured to engage a portion of the structure. The hook may be attached to the actuator such that operation of the actuator causes the actuator to pivot with respect to the hook. This pivoting of the actuator with respect to the hook may draw the engagement portion of the hook toward the support bar.

Another embodiment of a security device of the present invention for at least one door includes a support bar, attachment means, and an actuation mechanism. The support bar has first and second ends and the attachment means is mounted to the support bar for removably attaching the security device to a portion of the door. The actuation mechanism is connected to the attachment means. The actuation mechanism includes a camming surface that is engageable with a portion of the actuation mechanism to secure the security device in a position with respect to the door.

The actuation mechanism may include a handle assembly pivotably connected to the attachment means. The camming surface may be located on the handle assembly. A pivot point may be included about which the camming surface pivots in response to actuation of the handle assembly. The camming surface may include a first surface, an angled second surface, and a third surface. The distance between the pivot point and the first surface may be less than the distance between the pivot point and the angled second surface. Furthermore, the distance between the pivot point and the angled second surface may be less than the distance between the pivot point and the third surface. Pivotal actuation of the handle assembly may cause the camming surface to pivot such that the first, second, and third surfaces contact, in turn, a portion of the actuation mechanism. The first surface and third surface may be disposed substantially orthogonal to one another. The angled second surface may be angled approximately 45 degrees from the horizontal.

The portion of the actuation mechanism may be either the support bar or a blocking means. There may be two doors and the blocking means may be a blocking member that engages either one of the doors or a mullion separating the doors. Alternatively, the blocking means may include two blocking members one of which is engaged with one of the doors and the other of which is engaged with the other door.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
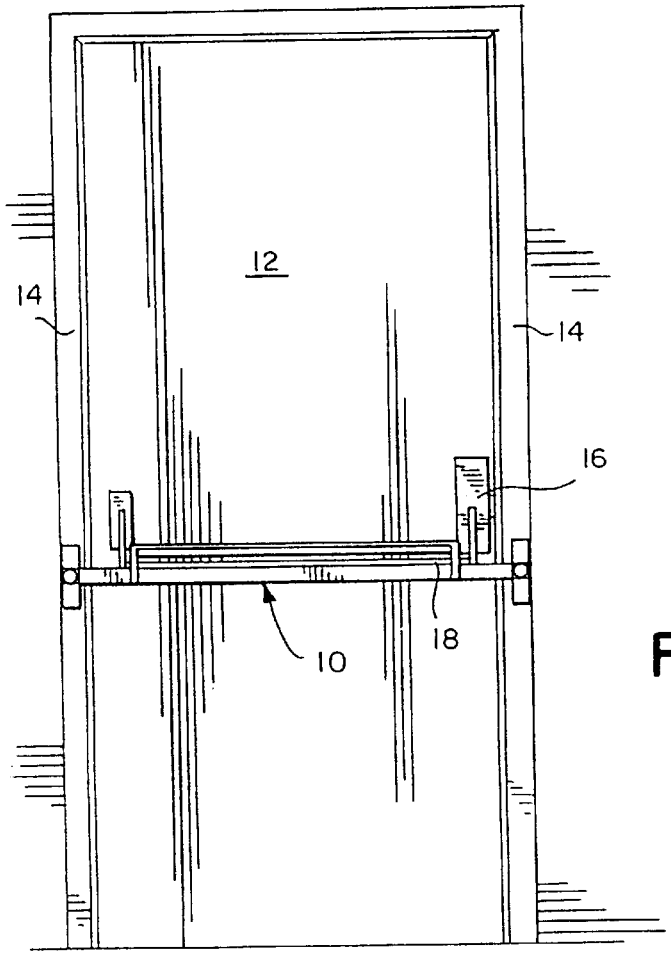
FIG. 1 is a front view of the door security device of the present invention, shown mounted to a door.

FIG. 1 shows a front view of a door security device in accordance with the present invention, generally indicated by the reference numeral 10. Security device 10 is designed to prevent a one-way door, that is, a door which opens in only one direction, from being opened. The device is positioned on the inside of an out-swinging door, and is a deterrent to burglars and others who may attempt to open the door without authorization. Security device 10 of the present invention is particularly compatible with a door equipped with a panic-bar handle.

Door 12 is typically mounted within door frame 14. Panic-bar handle assembly 16 includes rod 18, which extends substantially horizontally across the width of door 12. Security device 10 of the present invention is particularly designed for use with this type of handle hardware. However, it should be well understood that the present invention can also be used with doors having other types of handle hardware.

Figure 2:
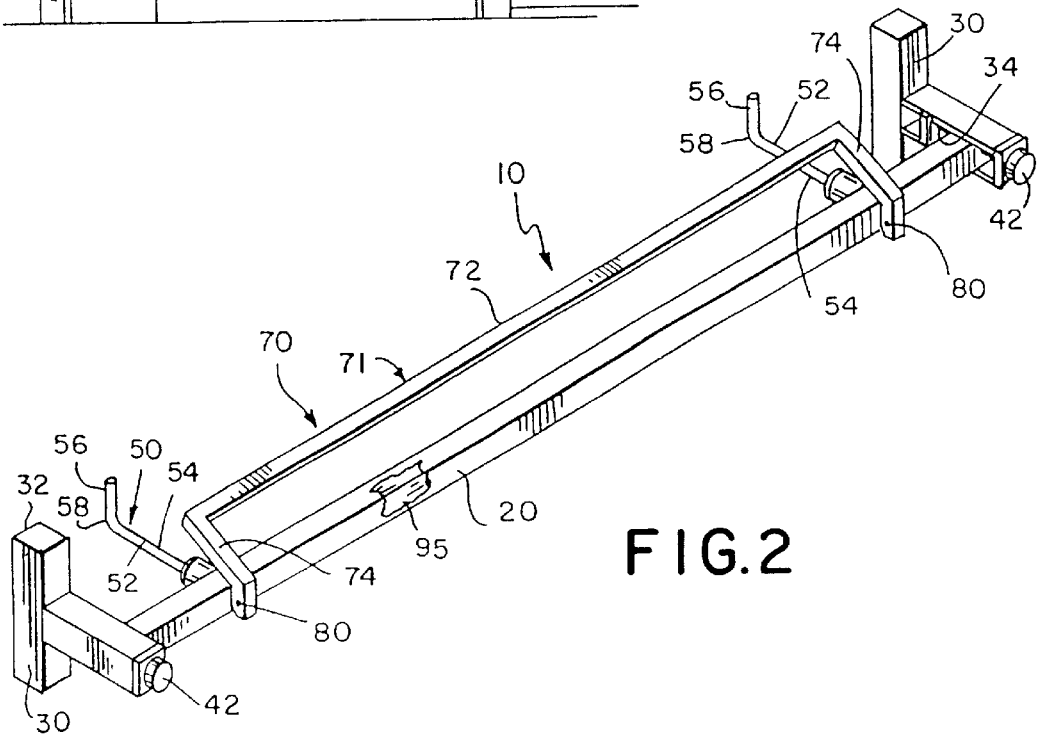
FIG. 2 is a perspective view of a door security device of the present invention.

As can be seen in FIG. 2, security device 10 includes support bar 20, opposing blocking members 30, attachment means 5O, and actuation mechanism 70. Support bar 20 is a generally elongate, rigid body. As shown in FIG. 2, support bar 20 may be generally rectangular in cross-section. However, support bar 20 may also be designed having a different cross-sectional configuration, and the present invention is not limited by the shape of the support bar. It is preferred that support bar 20 be rigid and sturdy, so as to withstand the forces which may be applied to the door by a burglar. Thus, one illustrative material from which support bar 20 may be constructed is steel. Support bar 20 may be substantially solid if extra strength is a concern, or it may be at least partially hollow, thus reducing the overall weight of security device 10.

Security device 10 includes two blocking members 30, one attached to each end of support bar 20. Blocking members 30 are designed to abut and rest flush against door frame 14, and thus it is desired that blocking members 30 be longitudinally spaced along support bar 20 by a distance equal to the width of door frame 14. Each blocking member 30 includes blocking surface 32 thereon. In the illustrative embodiments shown, blocking surface 32 is a substantially flat, planar surface. Blocking surface 32 is designed to abut and rest flush against door frame 14 when security device 10 has been mounted. Blocking members 30 insure that security device 10 is securely positioned against door frame 14, substantially perpendicular to the door frame. The dimensions of blocking member 30 and blocking surface 32 may be varied to create more or less bearing surface between the blocking member and the door frame. Blocking member 30 may be made from any suitable material, such as wood, plastic or the like.

Each blocking member 30 also includes a receiving means which receives an end of support bar 20. In the illustrative embodiment shown, the receiving means includes slot 34 therein. Slot 34 is substantially coplanar with an orthogonal to the longitudinal axis of support bar 20. Thus, support bar 20 may translate within slot 34 in a direction substantially orthogonal to the longitudinal axis of the bar.

Figure 3:
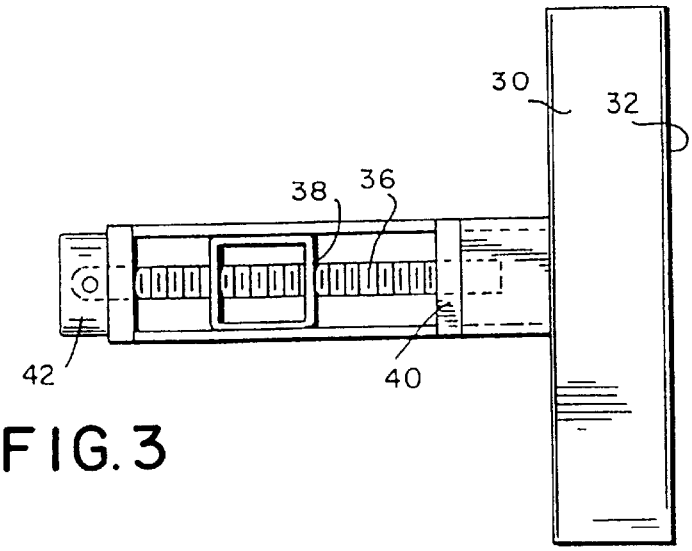
FIG. 3 is a side cut-away view of a blocking member of the present invention.

Each end of support bar 20 is receivable within slot 34 in the receiving means. This secures blocking member 30 to support bar 20. A variable adjustment mechanism, such as threaded bolt 36, is housed within the receiving means. Threaded bolt 36 engages threaded portion 38 of support bar 20. Bolt 36 is axially fixed within slot 34 to plate 40, but is free to rotate. Bolt 36 includes knob 42 thereon, such that by turning knob 42 bolt 36 rotates, causing support bar 20 to translate within slot 34. This mechanism allows support bar 20 to be adjustably positioned relative to blocking member 30, within slot 34. This mechanism can been seen in FIG. 3.

Intermediate the opposite ends of support bar 20, security device 10 includes attachment means 50. Attachment means 50 provides the means by which the security device is removably attached to door 12. Attachment means 50 includes at least one hook 52, which is mounted to support bar 20 intermediate the ends of the support bar. The number of hooks 52 utilized may vary; the illustrative embodiments shown include two hooks 52 mounted to support bar 20. The present invention is not limited by the number of hooks 52 used, nor by the relative positioning of the hooks longitudinally on support bar 20.

Each hook 52 is generally J-shaped, and includes stem 54 and engagement portion 56. Stem 54 is substantially elongate and straight. The end of stem 54 opposite engagement portion 56 is disposed in an opening which extends through support bar 20, such that the hook extends substantially orthogonally from bar 20 toward door 12.

Figure 4:
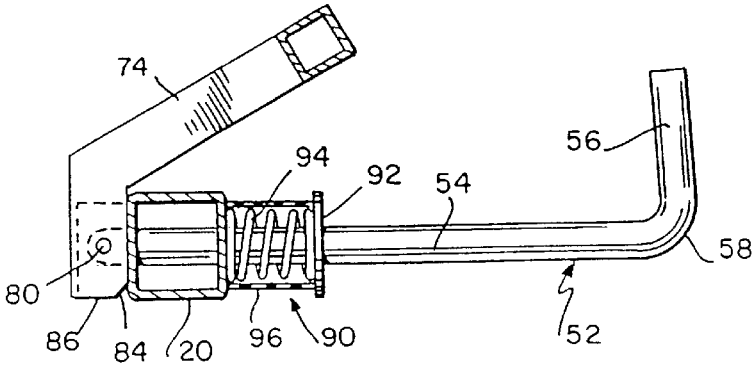
FIG. 4 is a side cut-away view of the present invention showing the attachment mechanism and spring mechanism.

Engagement portion 56 physically engages a portion of door 12 when security device 10 is mounted thereto. In one illustrative embodiment, engagement portion 56 includes curve 58. Curve 58 transitions from stem 54 to form the generally J-shaped body. Curve 50 is positioned such that the "open" portion of the curve faces generally upward. This can be seen in FIG. 4.

Security device 10 also includes an actuation mechanism. In the illustrative embodiment shown, the actuation mechanism includes handle assembly 70. Handle assembly 70 includes a generally elongate bar 72 which is disposed substantially parallel to support bar 20. At its opposite ends, bar 72 includes elbow 74 attached thereto. Each elbow 74 terminates adjacent support bar 20.

The end of elbow 74 which terminates adjacent support bar 20 is pivotally connected to attachment means 50. In the illustrative embodiment shown in FIG. 5, stem 54 of hook 52 extends substantially through support bar 20, and slightly outside of the support bar on the opposite side. Pin 80 is disposed substantially orthogonally through stem 54, and elbow 74 is connected to pin 80, such that the elbow may pivot or rotate about the pin. This also allows elbow 74, and thus bar 72, to pivot with respect to support bar 20.

Elbow 74 includes a camming surface 76 thereon. Camming surface 76 contacts support bar 20 as bar 72 is pivoted with respect to the bar. Camming surface 76 may be generally of any shape, including a rounded shape, an elliptical shape, or a multi-step shape. In the embodiments shown, camming surface 76 includes three discrete surfaces. Camming surface 76 generally includes first surface 82, angled second surface 84 and third surface 86. First surface 82 and third surface 86 are substantially orthogonal to one another, and are connected by angled surface 84. When security device 10 is in a rest position, prior to actuation, first surface 82 is substantially vertical and third surface 86 is substantially horizontal. Angled surface 84 extends generally at an angle of 45° from both the horizontal and vertical. However, the angles at which first surface 82, angled surface 84 and third surface 86 are oriented are illustrative, and are not intended to limit the scope of the present invention. Camming surface 76 is shown in detail in FIG. 5.

Figure 5:
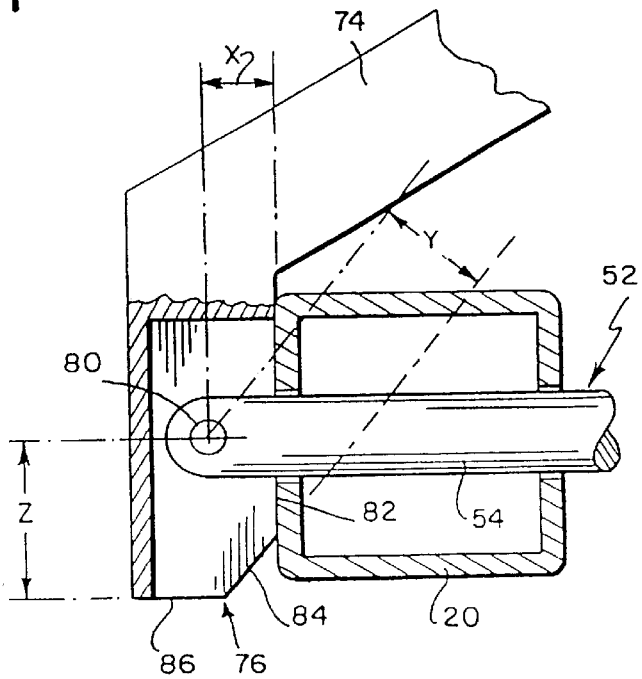
FIG. 5 is a partial view of the handle assembly and support bar of the present invention, showing detail of the camming surface.

FIG. 5 also shows the spatial relationship of pin 80 to camming surface 76. Pin 80 acts as a pivot point for camming surface 76. The perpendicular distance between pin 80 and each of the three surfaces on camming surface 76 is fixed; that is, the distance between pin 80 and first surface 82 is fixed, and may be represented by the letter "X," the distance between pin 80 and angled surface 84 may be represented by "Y," and the distance between pin 80 and third surface 86 may be represented by "Z." In the illustrative embodiments shown, $X<Y<Z$.

Security device 10 also includes spring mechanism 90. Spring mechanism 90 includes washer 92, coil spring 94 and casing 96. Coil spring 94 is positioned about stem 54 of hook 52, adjacent support bar 20, such that the coil spring substantially surrounds stem 54. Washer 92 is secured to stem 54 adjacent one end of the spring. The opposite end of coil spring 94 abuts the support bar. Casing 96 surrounds coil spring 94, and prevents dirt or other debris from interfering with the workings of the spring. Casing 96 is preferably flexible, such that it may contract and expand with coil spring 94.

Spring mechanism 90 acts as an aid to the release of security device 10 from an actuated position to a rest position. When security device 10 is actuated, coil spring 94 is compressed, exerting a force on support bar 20 and on washer 92. The force on washer 92 is directed substantially away from support bar 20, thus tending to push hook 52 away from the support bar, to a pre-actuation state. When a user releases handle assembly 70 of the present invention, the user is assisted in pushing bar 72 toward door 12 by the tension created by coil spring 94 against washer 92.

Figure 6:
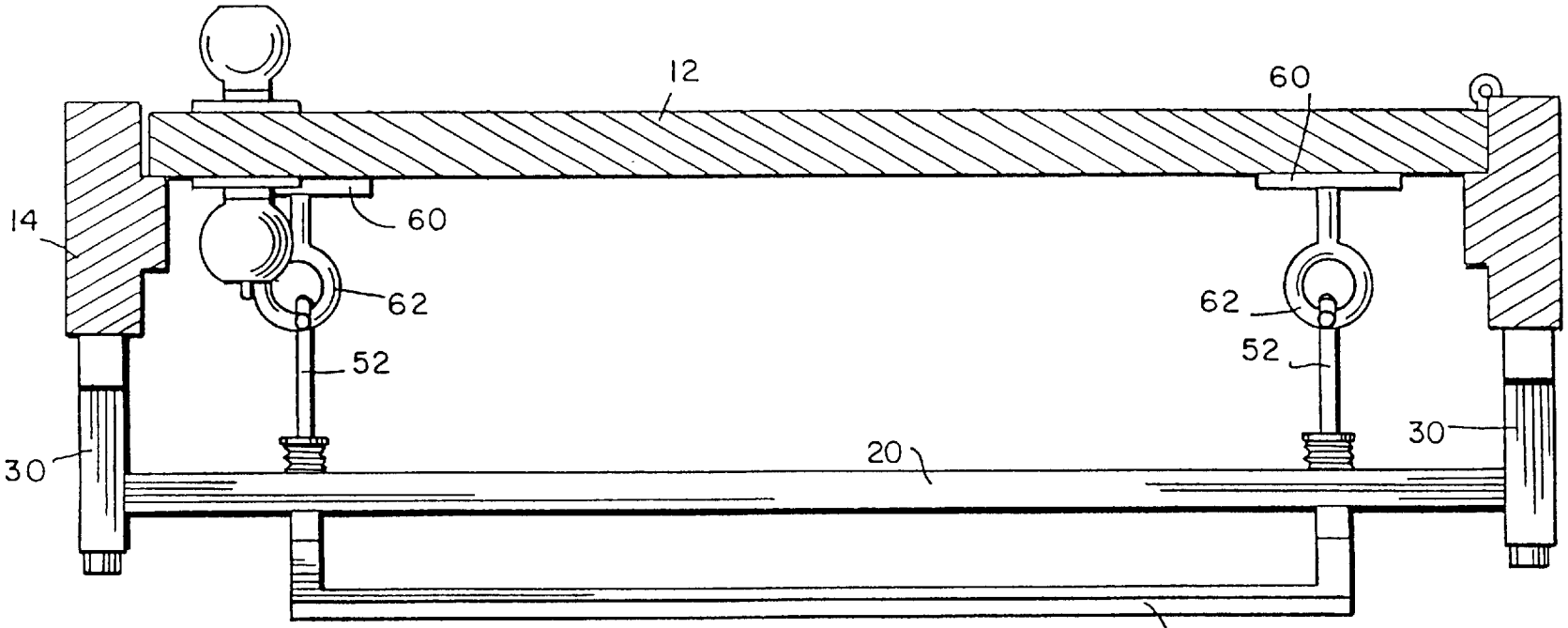
FIG. 6 is a plan view of another illustrative embodiment of the present invention, in conjunction with a door which does not utilize a panic bar.

Security device 10 can be used in conjunction with door 12 having various types of handle hardware. For example, the present invention is compatible for use with door 12 having panic-bar handle 16 as a handle. The present invention is also compatible with doors having other types of handle hardware, such as a conventional door knob. When used with this type of door, the present invention also includes receiving means 60. Receiving means 60 is mounted to door 12, and engagingly receives attachment means 50 mounted on support bar 12. For illustrative purposes, receiving means 60 may include eyelets 62. In this embodiment, it is preferred that door 12 be equipped with an eyelet 62 to correspond to each hook 52 mounted on support bar 20. This embodiment is illustrated in FIG. 6.

Portions or all of security device 10 may be coated with various coatings. For example, portions or all of security device 10 may be painted to make the device more aesthetically pleasing. Also, other coatings may be applied to portions or all of the security device, such that the device does not scratch or otherwise harm door 12. Such coatings may be any non-abrasive coating or substance (not shown) which deters or limits scratching or other effects caused by the rubbing of two surfaces together.

Directing attention now to FIG. 7, the ease with which security device 10 may be installed and removed can be easily appreciated. When it is desired to prevent door 12 from being opened, security device 10 may be used. In door 12 having panic-bar handle 16, security device 10 is positioned about the handle such that blocking surface 32 of blocking member 30 is adjacent door frame 14. This allows hook 52 to clear rod 18 of the panic-bar, and allows engagement portion 56 to receive the rod therein. Once the panic bar is received within hook 52, knob 42 may be turned, thereby adjusting the relative position of support bar 20 with respect to blocking member 30. At this point, security device 10 is prepared to be actuated. This is shown in FIG. 7*c*.

Figure 7A:
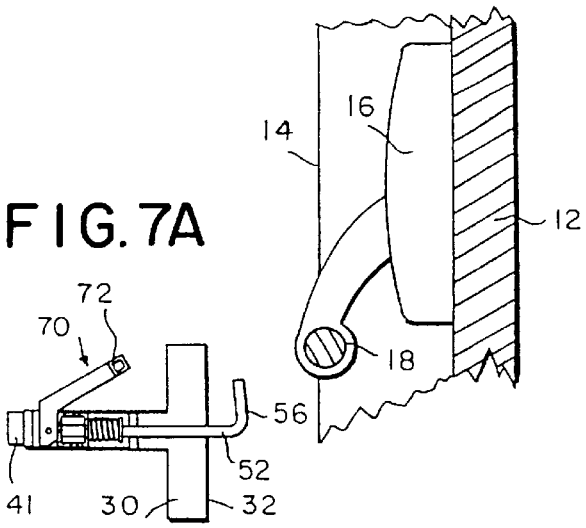
FIGS. 7*a* through 7*e* show a series of views of the security device of the present invention as it is mounted to a door and actuated into a locked position.
Figure 7D:
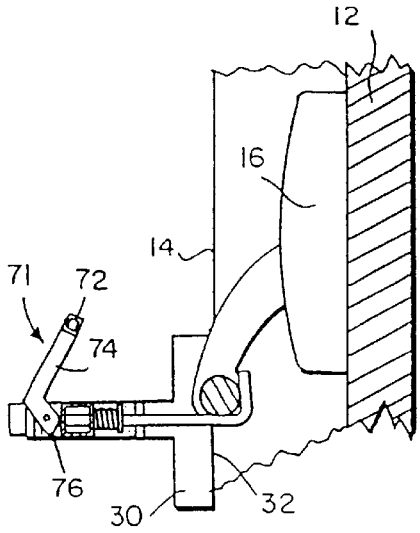
Figure 7B:
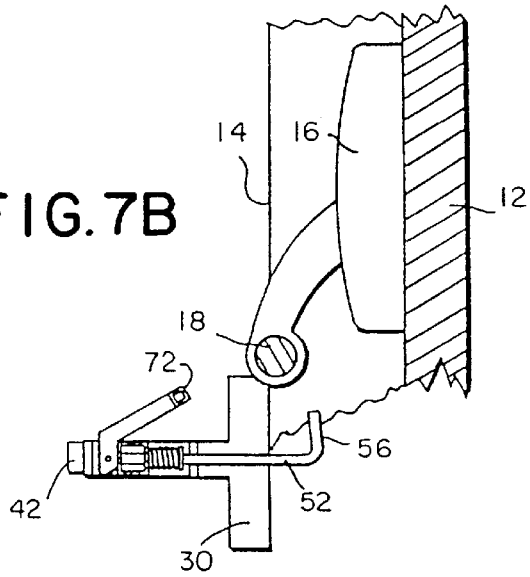
Figure 7E:
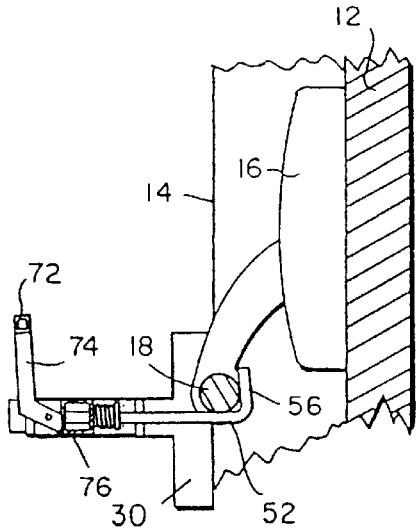
Figure 7C:
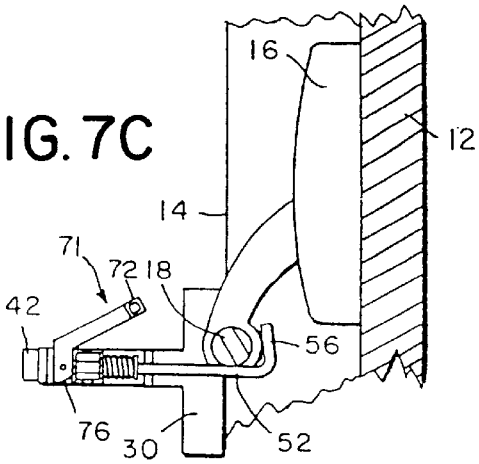

Security device 10 is actuated by pivoting handle assembly 70. A user may pivot bar 72 by grasping the bar and pulling it substantially away from door 12. As handle 72 is pivoting, the various surfaces of camming surface 76 on elbow 74 contact support bar 20. In the pre-actuation position, shown in FIG. 7*c*, first surface 82 rests substantially flush against support bar 20. As bar 72 is rotated, first surface 82 rotates away from the support bar and angled second surface 84 rotates into engagement, such that it rests substantially flush against support bar 20. This can be seen in FIG. 7*d*. When bar 72 is fully actuated, and pulled away from door 12 into a fully-operative position, third surface 86 rests substantially flush against support bar 20. This is shown in FIG. 7*e*. When security device 10 is in a fully-operative position, the positioning of handle 72 is easily viewable. Thus, a quick visual inspection insures that security device 10 is in position.

As bar 72 is actuated, and the various surfaces of camming surface 76 of elbow 74 rotate against support bar 20, hook 52 is drawn substantially away from door 12, toward support bar 20. This pulling action is effectively caused by increasing the distance between pin 80 and support bar 20. In the pre-actuation state, pin 80 is spaced from support bar 20 by a distance X, representing the distance between pin 80 and first surface 82. As bar 72 is rotated, the distance between pin 80 and support bar 20 is increased first to a distance Y, and finally to a distance Z, that distance between pin 80 and third surface 86. In this position, engagement portion 56 of hook 52 is pulled toward support bar 20 by a distance equal to the difference between X and Z.

Along with engagement portion 56, washer 92 is also pulled toward support bar 20. This exerts a force onto coil spring 94, and thus the spring is in a contracted position. The spring mechanism thus serves to tension the security device in place.

As engagement portion 56 of hook 52 is drawn toward support bar 20, rod 18 of panic bar handle 16 is pivoted slightly upward. This removes any mechanical slack which may be present in panic bar handle 16. Once this slack is removed, panic bar handle 16 is drawn towards support bar 20 by engagement portion 56 of hook 52. This pulling action also draws door 12 towards support bar 20. This pulling action draws door 12 snug against door frame 14, compressing against any weather stripping, mechanical slack or other spacing between door 12 and frame 14. This secures the door, such that there is little or no play or give between door 12 and frame 14.

Security device 10 is removed from engagement with door 12 by reversing the preceding steps of installation. A user grasping bar 72 can push the handle toward door 12, thus releasing third surface 86 from its flush alignment with support bar 20. The tension exerted on support bar 20 and washer 92 by coil spring 94 assists the user in pushing support bar 20 towards door 12. Camming surface 76 on elbow 74 transitions through angled second surface 84 and first surface 82, until the first surface rests substantially flush against support bar 20. In this position, the tension on coil spring 94 is released and security device 10 may be quickly and easily removed from engagement with the door hardware. In practice, only a small force need be applied to bar 72 to release security device 10. Once released, security device 10 will fall to the floor if not otherwise held during removal. Thus, security device 10 can be quickly and easily removed from its locked position in case of a panic situation.

Security device 10 of the present invention can be installed and removed in a similar manner when used on doors 12 having a knob handle or other handle hardware. In these instances, eyelets 62 are secured to the door, and act as a receiving mechanism for hooks 52. When security device 10 is to be mounted on such a door, hooks 52 are positioned such that engagement portion 56 is inserted through eyelets 62, and the eyelets are secured adjacent curve 58 of hook 52. Security device 10 is then positioned and actuated as recited above.

Figure 8:
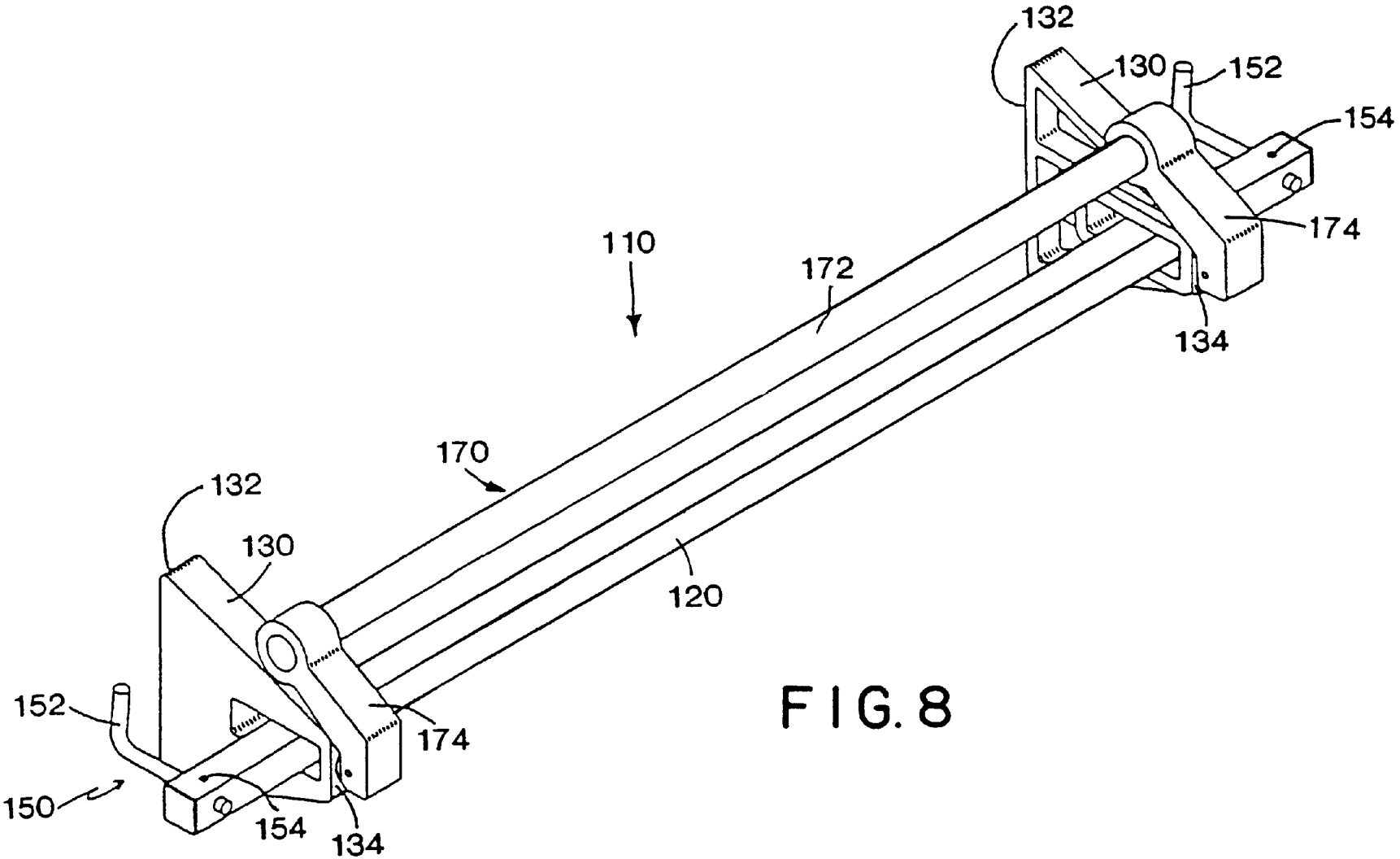
FIG. 8 is a perspective view of another illustrative embodiment of the security device of the present invention.
Figure 9:
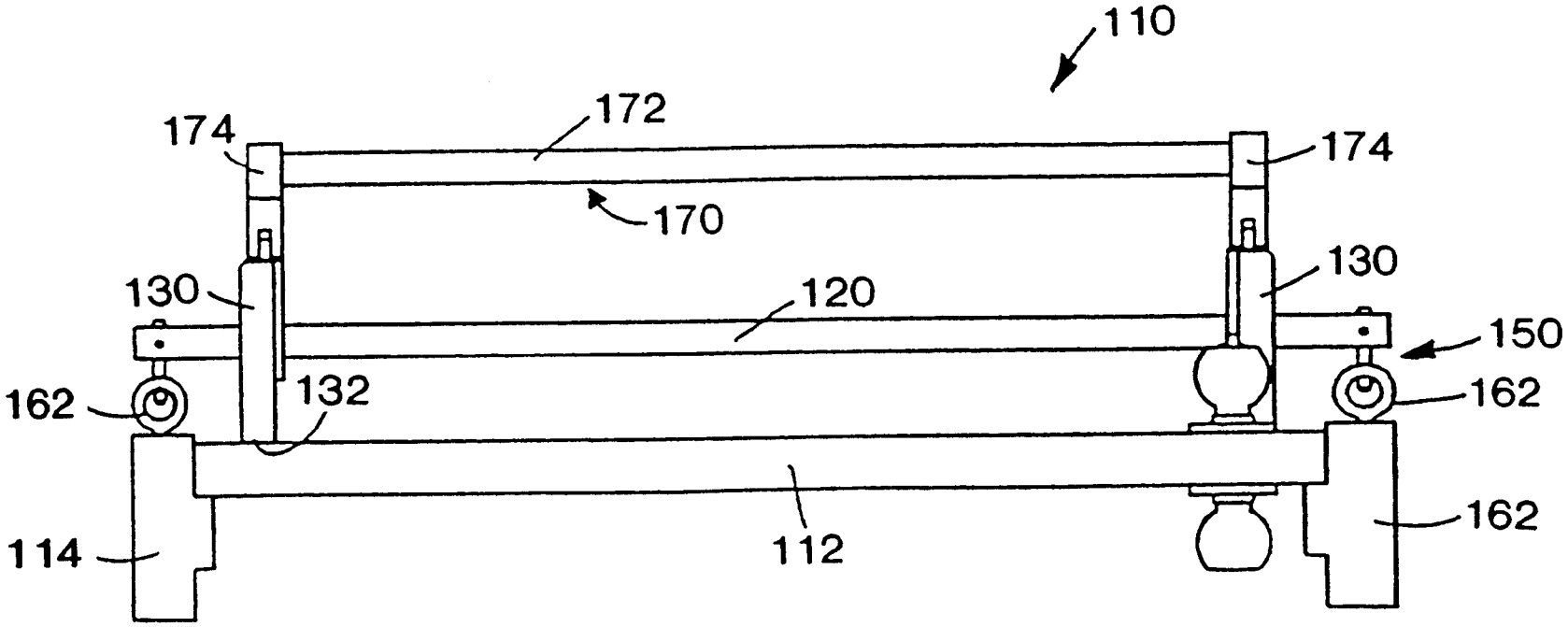
FIG. 9 is a plan view of the embodiment of the present invention shown in FIG. 8.

Another illustrative embodiment of the present invention is shown in FIGS. 8, 9 and 10(*a–e*), and is indicated by reference number 110. Security device 110 can be used in conjunction with inwardly swinging doors. In this embodiment of the present invention, attachment means 150, comprising hooks 152, are located adjacent distal ends of support bar 120. Hooks 152 are secured to the respective ends of support bar 120 by, for example, pins 154 which extend vertically through the ends of support bar 120 and holes (not shown) formed in the proximal end of hooks 152. A plurality of holes in hooks 152 may be provided to allow for easy adjustment of the distance between the upstanding, distal end of hooks 152 and support bar 120. In this embodiment, eyelets 162 (FIG. 9) are attached to door frame 114. Hooks 152 are engageably received by eyelets 162, as will be explained in more detail in connection with FIGS. 10*a*–10*e* below.

Blocking members 130 are positioned along support bar 120, between opposing hooks 152. Blocking members 130 are spaced apart from hooks 152, such that blocking surface 132 of blocking member 130 contacts door 112. If desired, an additional blocking member (or members) may be provided along support bar 120 to provide additional support and rigidity.

Security device 110 also includes an actuation mechanism. The actuation mechanism includes handle assembly 170 which comprises elongate bar 172 and elbows 174. Elbows 174 are mounted immediately adjacent surfaces 134 of blocking members 130. A pin (not shown) is pivotally connected to each elbow 174, and extends through surface 134 and is fixedly connected to support bar 120. The cam surface of each elbow 174 interacts with surface 134 of blocking member 130 in the manner discussed above in connection with FIGS. 4 and 5. When security device 110 is placed in the operative position (i.e., with the upstanding portions of hooks 152 received within the openings of eyelets 162), pulling back on handle assembly 170 will first pull hooks 152 back until they securely engage eyelets 162. Continuing to pull handle assembly 174 will push end blocks 130 firmly against door 112, and will compress springs 136 which are disposed within slot 138 of blocking members 130. Pushing handle assembly 170 forward will release the pressure and allow springs 136 to expand, causing blocking members 130 to return to their original positions. Continuing to push handle assembly 170 forward will push hooks 152 forward, disengaging them from eyelets 162 and allowing security device 110 to fall free.

Figure 10D:
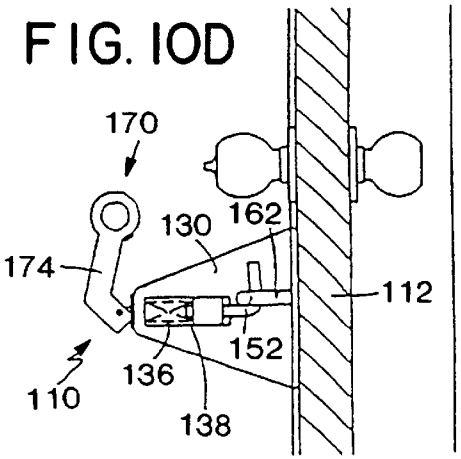
FIGS. 10*a*–10*e* illustrate a manner of usage of the embodiment of the invention shown in FIG. 8.
Figure 10E:
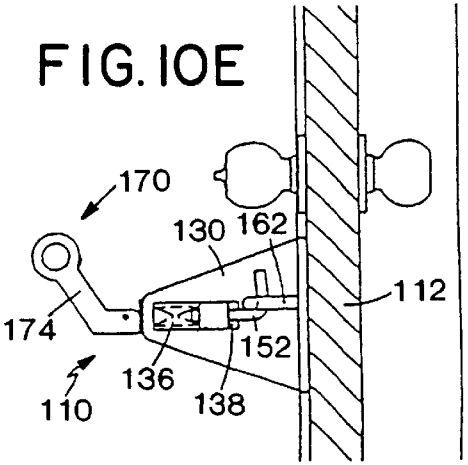
Figure 10B:
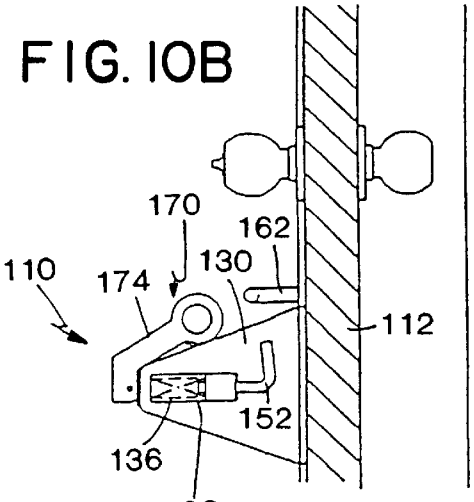
Figure 10C:
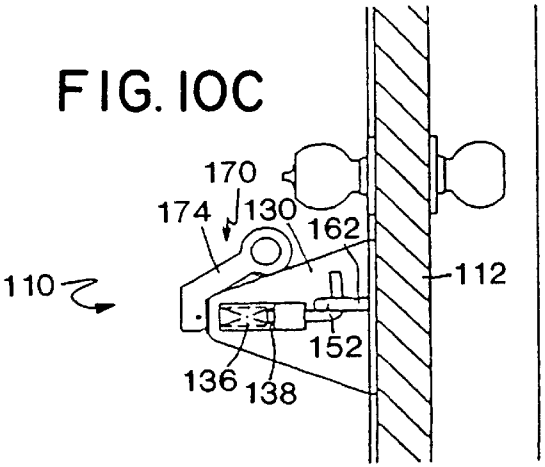
Figure 10A:
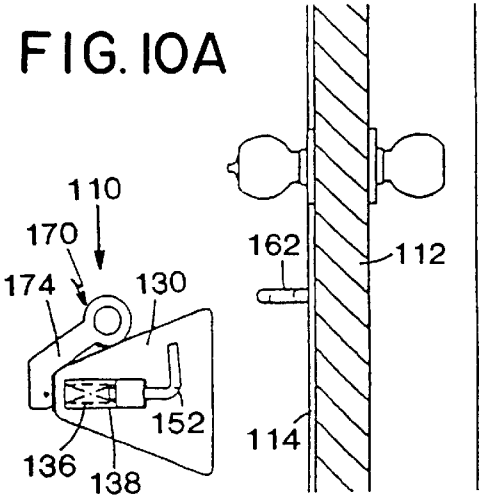

FIGS. 10*a*–10*e* illustrate the manner in which security device 110 is attached to in-swinging door 112. FIG. 10*a* shows security device 110 disposed adjacent door 112. Eyelets 162 are secured to frame 114. It should be noted that alternative mechanisms for receiving hooks 152 may be employed. For example, horizontally extending hooks engageable by the upstanding portion of hooks 152, appropriately sized and positioned openings within door frame 114, and other appropriate structures which are engageably by, or which engage, hooks 152 may be used.

In FIG. 10*b*, security device 110 is shown placed against door 112 below eyelets 162. In FIG. 10*c*, security device 110 has been moved upwardly such that the upstanding portions of hooks 152 engage eyelets 162. In FIG. 10*d*, handle assembly 170 has been moved in a direction away from door 112 so as to cause the inner surface of the upstanding portions of hooks 152 to engage the inner portions of eyelets 162. Finally, in FIG. 10*e*, handle assembly 170 is shown in a position which causes the cam surfaces described above to pull support bar 120 away from the door, and to push blocking members 130 toward the door, and to compress spring 136 to secure device 110 in the locked position. Blocking members 130 are positioned to rest substantially flush against door 112. Thus, security device 130 prevents burglars or other intruders from gaining access through in-swinging door 112.

It has been found that the hooks (52, 152) for all embodiments of the invention are preferably made from AISI No. 1043 steel, heat treated to a hardness of Rockwell C 40–45. To ensure that the hooks do not inadvertently disengage the eyelets, door handle, or other engaging structure, grooves or teeth may be added to the inside surface of each hook. Under high pressure, these hardened teeth will grip the adjacent material to reduce the possibility of unintended disengagement.

Figure 11:
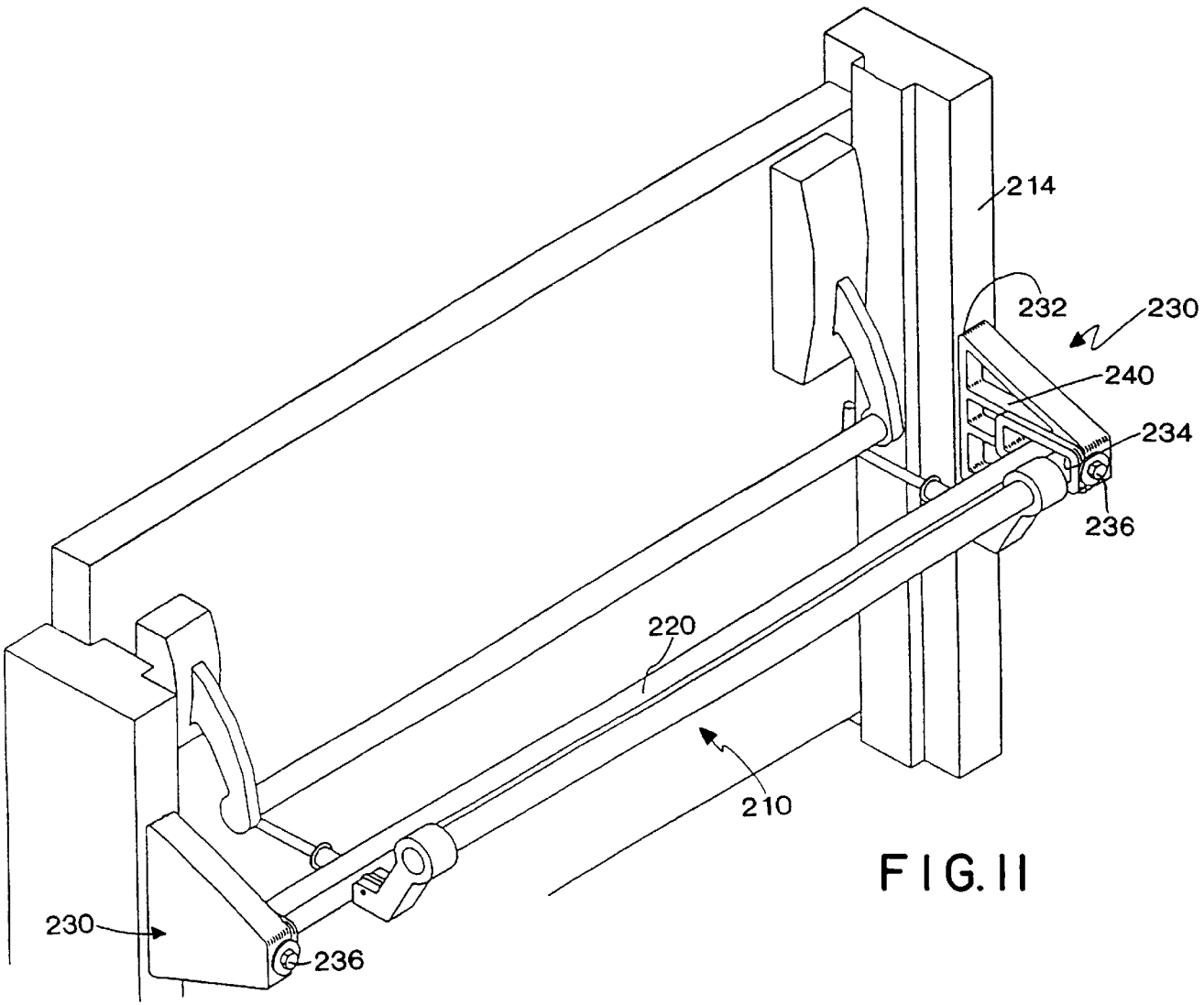
FIG. 11 shows another illustrative embodiment of a door security device of the present invention.

Another illustrative embodiment of the out-swinging door security device of the present invention is shown in FIG. 11, and indicated by the reference numeral 210. Security device 210 includes blocking members 230, each having a blocking surface 232 thereon, which is a substantially flat, planar surface. Blocking surface 232 is designed to abut and rest flush against door frame 214 when security device 210 has been mounted.

Blocking member 230 also includes a receiving means, illustratively shown to include slot 234. Slot 234 allows support bar 220 to translate therein, substantially orthogonally to the longitudinal axis of the bar. A variable adjustment mechanism, such as threaded bolt 236, is housed within the receiving means. Threaded bolt 236 engages a portion of support bar 220, such that by turning bolt 236, support bar 220 translates within slot 234.

Blocking member 230 also includes ribs 240 therein. Ribs 240 provide additional strength and rigidity to blocking member 230, while also reducing the weight of the blocking member.

Figure 12:
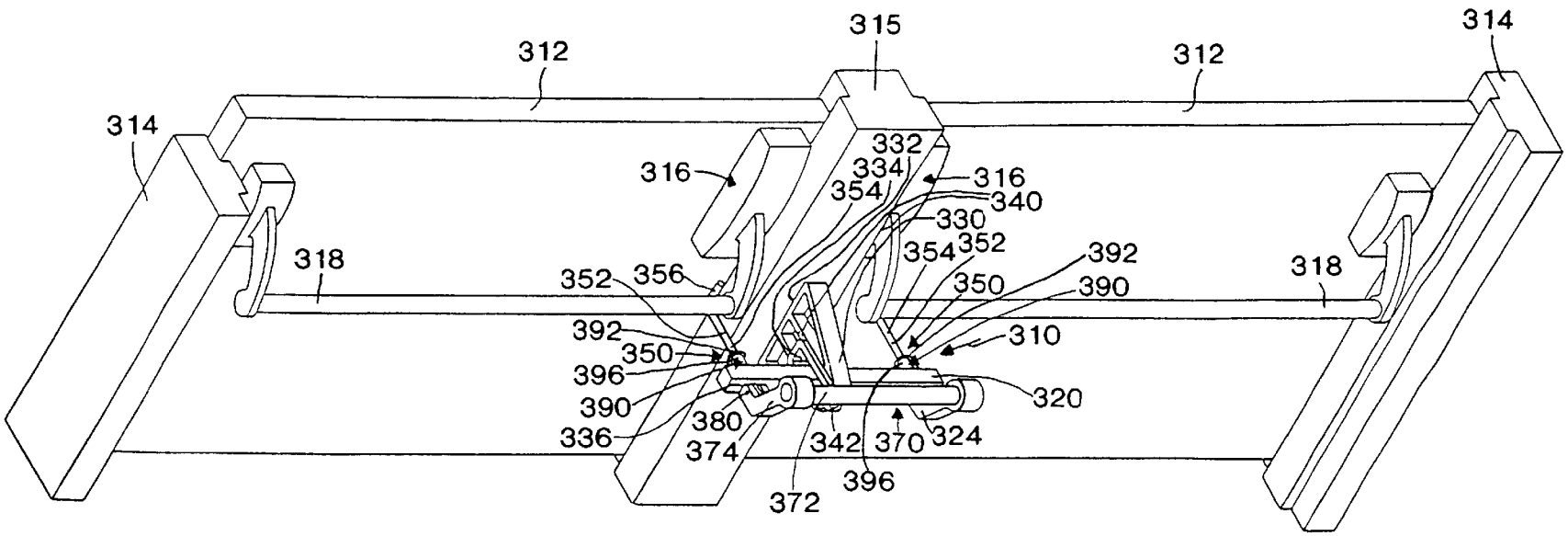
FIG. 12 is a perspective view of another illustrative embodiment of a security device of the present invention in use with a pair of doors separated by a mullion.
Figure 13:
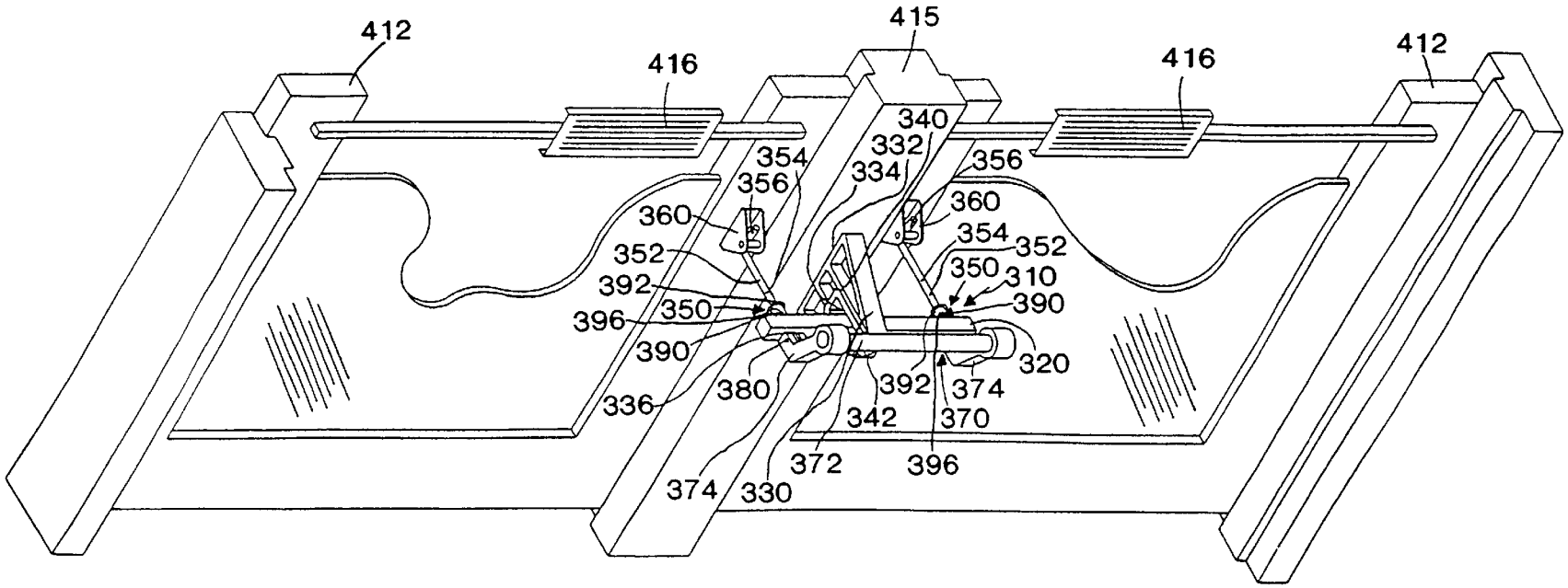
FIG. 13 is a perspective view of the security device illustrated in FIG. 12 in use with a pair of different doors separated by a mullion.
Figure 14:
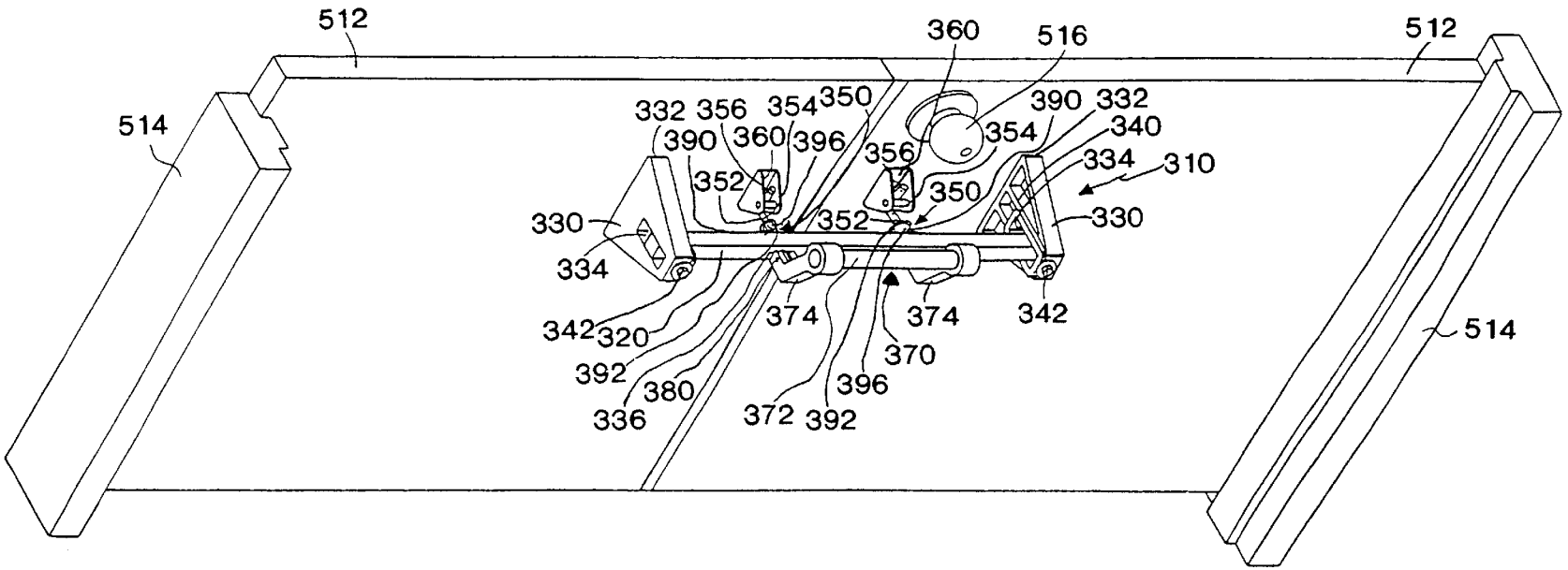
FIG. 14 is a perspective view of another illustrative embodiment of a security device of the present invention in use with a pair of doors that are hung adjacent one another without a mullion separating them.

Another illustrative embodiment of the present invention is shown in FIGS. 12–14 and indicated by reference numeral 310. Security device 310 can be used in conjunction with a variety of structures such as doors 312 shown in FIG. 12, doors 412 shown in FIG. 13, and doors 512 shown in FIG. 14. It is to be understood, however, that the uses for security device 310 illustrated in FIGS. 12–14 are not intended to limit other possible applications and uses for security device 310. For example, security device 310 may be used in connection with single doors where the device is mounted, for example, on either the door and door frame or the door and an adjacent wall. Another possible application for security device 310 is windows.

Doors 312 shown in FIG. 12 include door frames 314 on which doors 312 are hung and a mullion 315 that separates doors 312. Doors 312 additionally include panic bar handle assemblies 316 that include rods 318, as discussed above in connection with the single doors shown in FIG. 1.

Security device 310 includes a support bar 320 at least one blocking means or member 330, and attachment or attaching means 350 and an actuation mechanism or actuator 370.

As shown, for example, in FIG. 12 blocking member 330 includes a blocking surface 332 that contacts mullion 315. Although only a single blocking member 330 is shown in FIG. 312, as discussed above, an additional blocking member or members 330 may be used to provide additional support and rigidity.

Blocking member 330 includes a slot 334 in which support bar 320 is disposed. Slot 334 allows support bar 320 to translate therein, substantially orthogonally to a longitudinal axis of support bar 320. Each blocking member 330 may also include a variable adjustment mechanism like that shown and described in FIG. 3 above, that includes a knob 342 of a threaded member which may be turned so that support bar 320 translates within slot 334 as discussed above in other embodiments of the present invention.

Each blocking member 330 may additionally include one or more ribs 340 therein. Ribs 340 provide additional strength and rigidity to blocking member 330, while also reducing the weight of blocking member 330.

Attachment or attaching means 350 includes one or more attaching mechanisms for adjustably positioning support bar 320 with respect to blocking member 330. The attaching mechanism may include one or more hooks 352 that are located at the first and second end of support bar 320 on either side of blocking member 330 as shown, for example, in FIG. 12. Stems 354 of hooks 352 may be attached to elbows 374 of actuation mechanism or actuator 370 by-pins 380, as shown in, for example, FIG. 12 and previously described above with reference to FIGS. 4 and 5. Stems 354 may have one or more holes (not shown) through which pins 380 may be selectably disposed to couple to elbows 374. These plurality of holes in stems 354 are provided to allow for easy adjustment of the distance between engagement portions 356 of hooks 352 and support bar 320.

Security device 310 also includes spring mechanisms 390. Each spring mechanism 390 includes a washer 392, a casing 396, and a spring (not shown) positioned about a stem 354 of hook 352 and disposed within casing 396. The operation of spring mechanism 390 is substantially the same as that described above and illustrated in FIG. 4.

Actuation mechanism or actuator 370 includes an elongate bar or rod 372. Elbows 374, described above, are connected on opposing ends of rod 372 as shown. Elbows 374 are mounted immediately adjacent surfaces 336 of support bar 320. A cam surface on each elbow (not shown) like that discussed above in connection with FIGS. 4 and 5 interacts with surfaces 336 on support bar 320 in a manner similar or identical to that discussed above in connection with FIGS. 4 and 5.

When security device 310 is placed in an operative position (i.e., with engagement portions 356 of hooks 352 adjoining rods 318 of panic bar handle assemblies 316), pulling on and pivoting actuation mechanism or actuator 370 away from doors 312 and mullion 315 will first pull hooks 352 back until they securely engage rods 318. The variable adjustment mechanism of each blocking member 330 may be actuated via knob 342 to initially position security device 310 adjacent doors 312 and mullion 315 in a manner similar or identical to that discussed above in connection with FIG. 3. Continuing to pull on actuation mechanism or actuator 370 will push blocking member 330 firmly against mullion 315, and will compress the springs of spring mechanisms 390, securing support bar 320 adjacent doors 312. Pushing actuation mechanism or actuator 370 toward doors 312 and mullion 315 will allow the springs of spring mechanisms 390 to expand. Continuing to push actuation mechanism or actuator 370 forward will push hooks 352 forward toward doors 312 until they disengage from rods 318 of handle assemblies 316 allowing security device 310 to fall free, unless otherwise held in place by blocking member 330.

An alternative use for security device 310 with doors 412 having different handle assemblies 416 is shown in FIG. 13. In this embodiment, receiving means or attachment blocks 360 are secured to a portion of each of doors 412. Receiving means or attachment blocks 360 each receive engagement portion 356 of a hook 352 to secure support bar 320 adjacent the door and mullion structure shown in FIG. 13. It should noted that other mechanisms for receiving components of attachment or attaching means 350 may be used. For example, eyelets, such as eyelets 62 shown in FIG. 6, may be used. Alternatively, appropriately sized and positioned openings within a door frame, such as frame 414 may be used. The present invention is not limited by such alternative mechanisms, rather, these mechanisms are adapted to be used with particular attachment or attaching means structure.

FIG. 13 depicts the security device used in conjunction with glass doors. It is to be understood from FIG. 13 (and FIG. 16) that the security device could also be used in conjunction with a pair of hinged windows or in conjunction with a single hinged window, inasmuch as any structural differences between glass doors and windows would not effect any structural differences in the security device.

Another application for security device 310 for use with a pair of doors 514 that are hung adjacent one another in a frame 514 without a mullion separating them is shown in FIG. 14. This embodiment utilizes a pair of receiving means or attachment blocks 360 and a pair of blocking means or members 330 to secure support bar 320 in a position adjacent door structure 512. A handle assembly 516 is shown as mounted in one of doors 512. As can be seen in FIG. 14, in this application of security device 310, no cooperation with a handle assembly is required to operate or secure security device 310.

Figure 15:
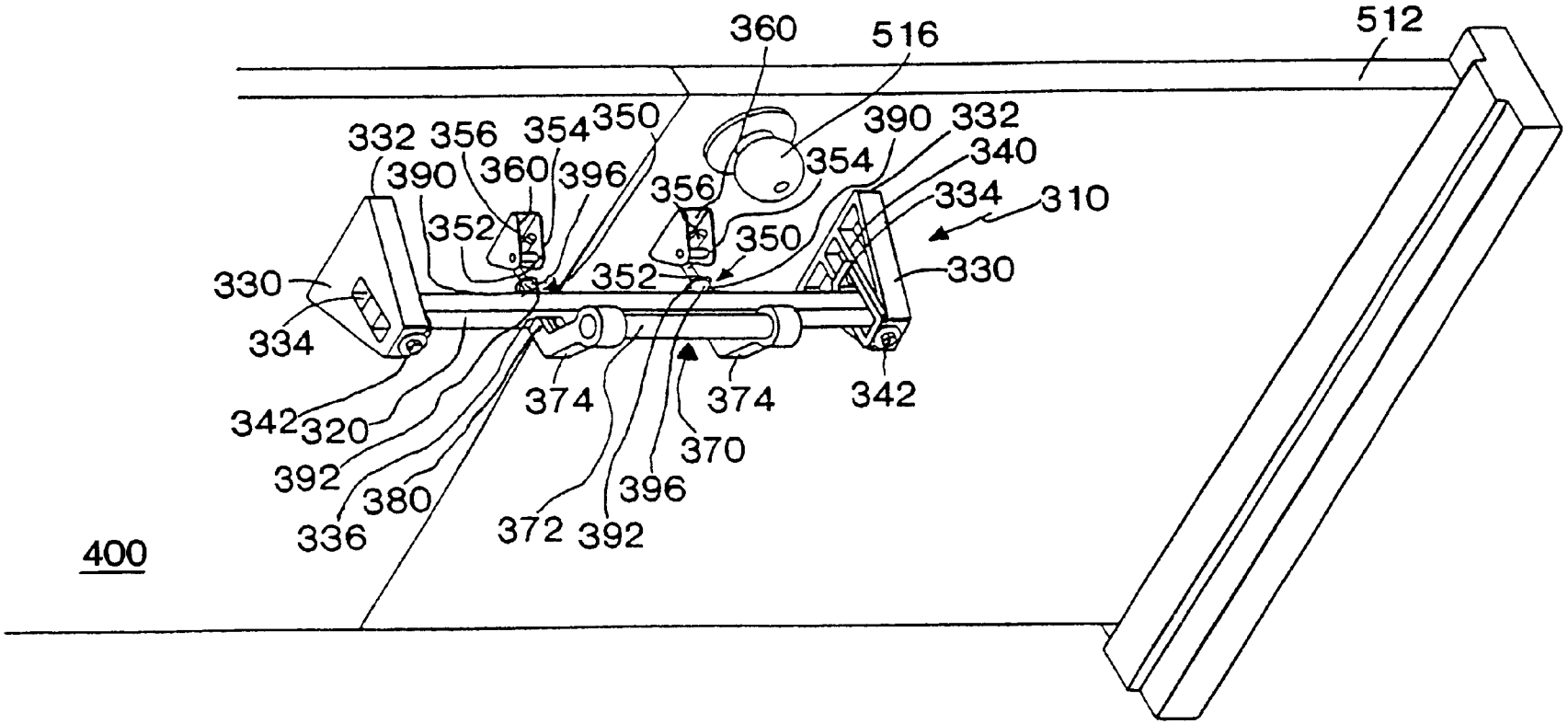
FIG. 15 is a perspective view of the security device of the present invention in use with a single door that does not include a panic bar handle assembly.

As mentioned above, the security device of the present invention may be used in connection with single doors where the device is mounted, for example, on either the door and door frame or the door and an adjacent wall. FIG. 15 is a perspective view of the security device of the present invention in use with a single door that does not include a panic bar handle assembly. In this embodiment, one of the attachment blocks 360 secures one of the blocking members 330 to wall 400.

Figure 16:
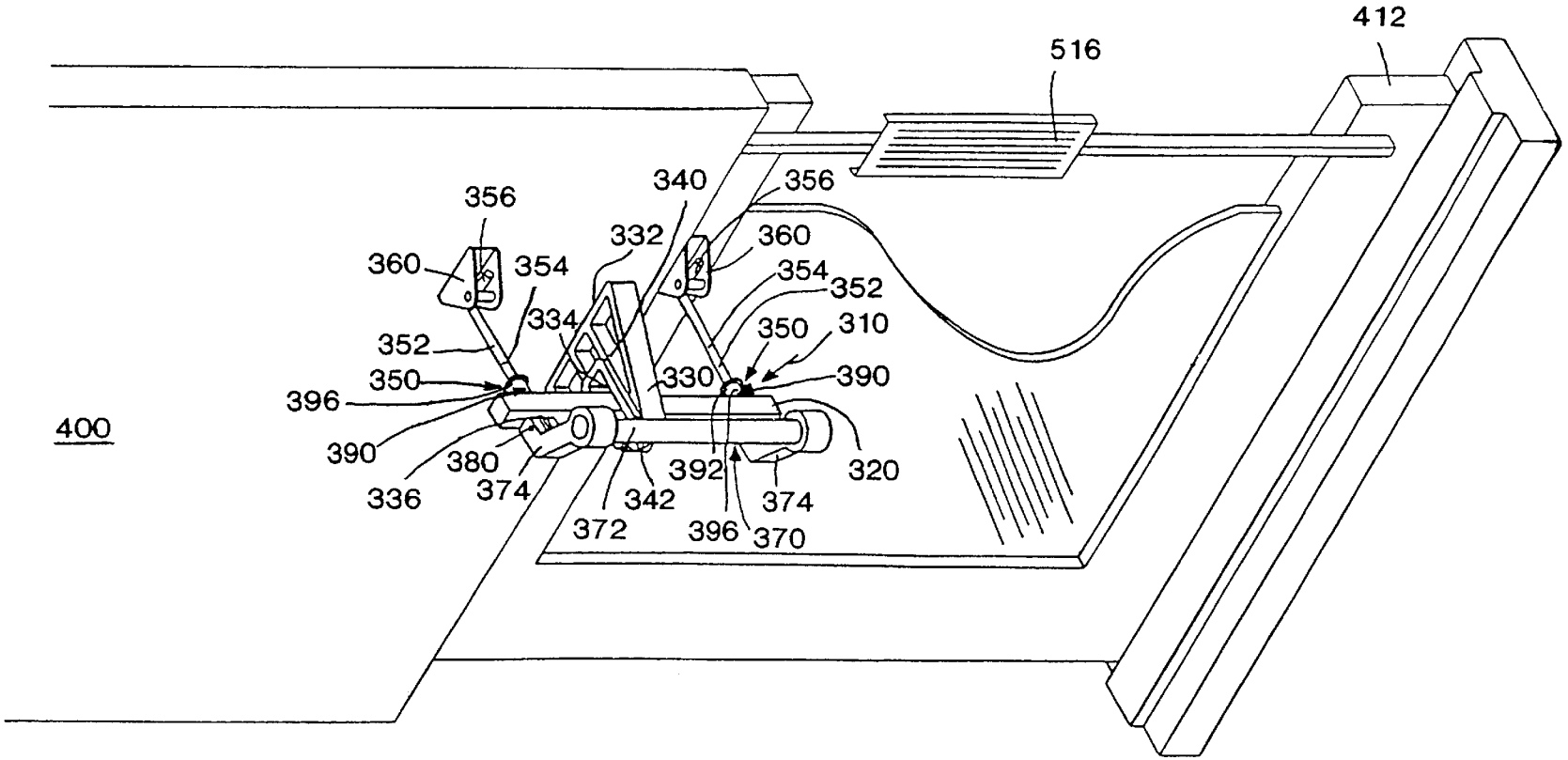
FIG. 16 is a perspective view of the security device of the present invention in use with a single glass door.

FIG. 16 is a perspective view of the security device of the present invention in use with a single glass door. In this embodiment, one of the attachment blocks 360 secures a single blocking member 330 to wall 400.

Figure 17:
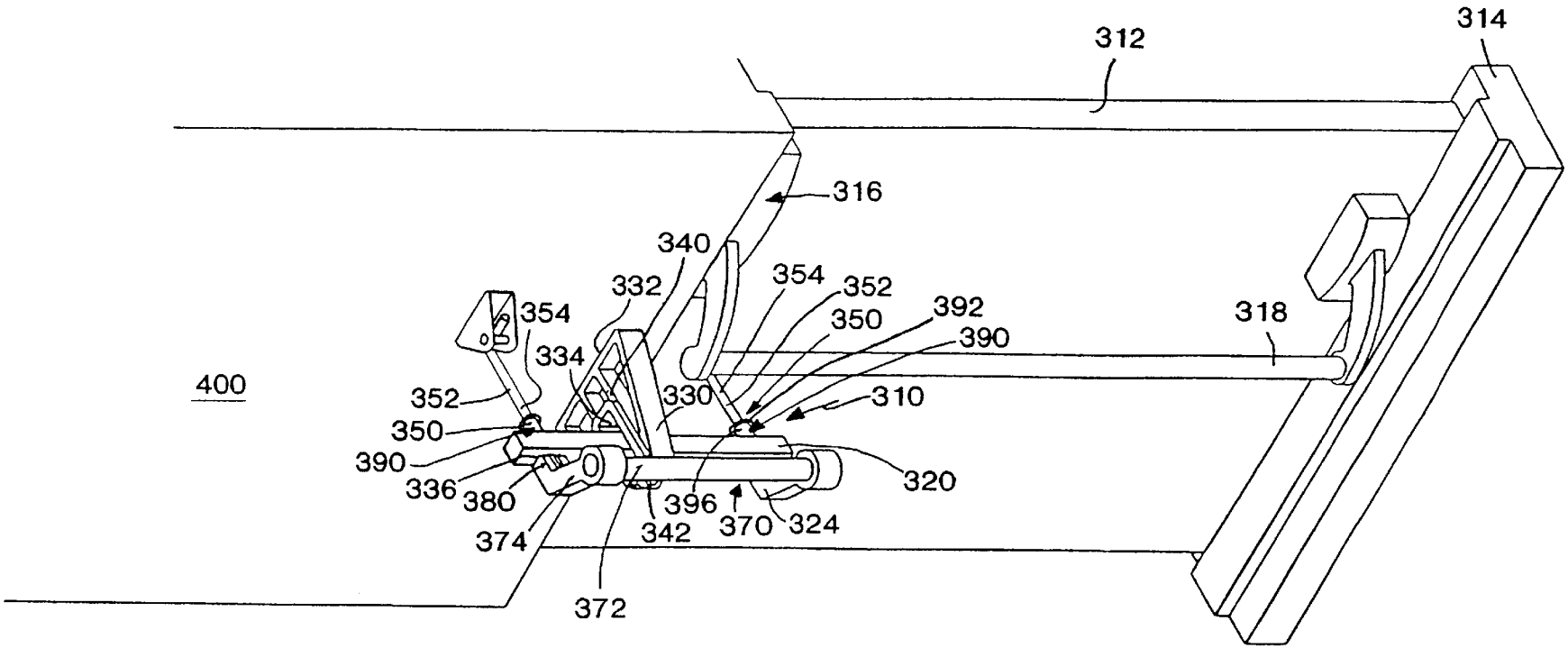
FIG. 17 is a perspective view of the security device of the present invention in use with a single door that has a panic bar handle assembly.

FIG. 17 is a perspective view of the security device of the present invention in use with a single door that has a panic bar handle assembly. In this embodiment, the device is secured to wall 400 in a manner similar to that shown in FIG. 16.

As discussed above, according to different embodiments of the present invention, the receiving means or attachment block(s) can be secured to various support structures, including one or more doors, a mullion between two doors, a door frame and/or a wall adjacent a door. Although various mechanical fasteners such as bolts, screws, weldments, etc., can be used to secure the receiving means or attachment blocks to support structures, there are considerations which may dictate the use of chemical means such as adhesives, epoxies, glues, cements, etc. by which to secure the receiving means or attachment blocks to support structures.

Figure 18:
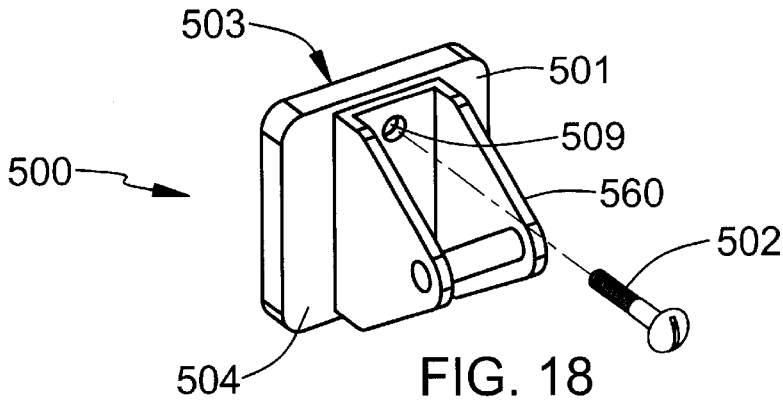
FIG. 18 is a perspective view of a receiving means or attachment block assembly which is designed to be chemically attached to a support structure.

For example, in some instances, the use of mechanical means which pass through wooden doors may adversely effect the fire rating of such doors. That is, the use of metal elements such as bolts, screws, etc. which pass through wooden doors may concentrate and transfer heat into the door. Moreover, mechanical fasteners which extend through doors allow external access to exposed portions thereof which can be subject to tampering, e.g. drilling, cutting, etc. by intruders. The use of chemical means to secure the receiving means or attachment blocks as described herein would avoid the use of mechanical elements which extend through a door. In addition, the use of chemical means to secure the receiving means or attachment block(s) is particularly suitable for use in conjunction with glass doors as discussed below. FIG. 18 is a perspective view of a receiving means or attachment block assembly which is designed to be attached to a support structure by chemical means according to the present invention. The attachment block assembly 500 includes a surface-mount base plate 501 and a receiving means or attachment block 560. The receiving means or attachment block 560 is similar to the receiving means or attachment blocks 360 depicted in FIGS. 13–17. The receiving means or attachment block 560 can be attached to the surface-mount base plate 501 by mechanical fasteners 502 which may include bolts, screws, or the like.

Figure 19:
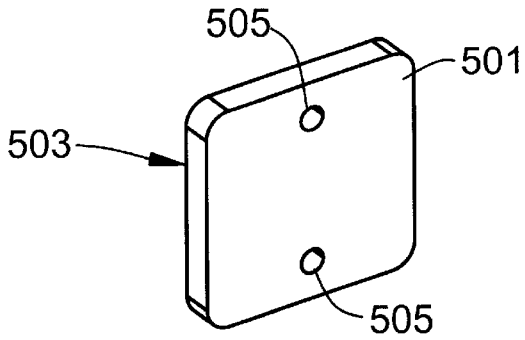
FIG. 19 is a perspective view of the surface-mount base plate of FIG. 18.

FIG. 19 is a perspective view of the surface-mount base plate of FIG. 18. The surface-mount base plate 501 includes a mounting surface 503 which is flat. According to one embodiment, the mounting surface 503 was machined to have a flatness tolerance which limited the bondline gap to between about 0.05 mm to about 0.5 mm. The bondline gap is the gap due to surface irregularities which has to be spanned by adhesives, glues, cements or the like. The face 504 of the surface-mount base plate 501 includes two or more bores 505 which are provided to receive the mechanical fasteners 502 that are used to secure the receiving means or attachment block 560 to the surface-mount base plate 501. Bores 505 may include internal threads or other structural features which cooperate to engage mechanical fasteners 502.

Although the surface-mount base plate 501 is depicted as having a square shape, it is to be understood that the surface-mount base plate 501 can be of any convenient shape, including rectangular, circular, triangular, polygonal, etc. It is also within the scope of the present invention to have the receiving means or attachment block 560 permanently attached to the surface-mount base plate 501 or to form the attachment block assembly 500 as an integral structure.

Figure 20:
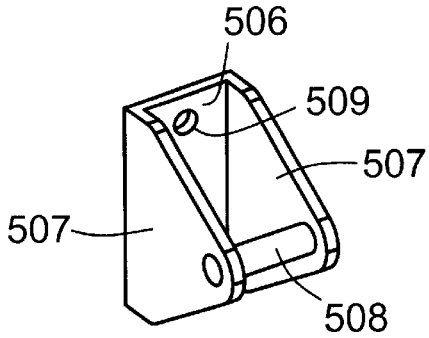
FIG. 20 is a perspective view of the receiving means or attachment block of FIG. 18.

FIG. 20 is a perspective view of the receiving means or attachment block of FIG. 18. This receiving means or attachment block 560 is similar to the receiving means or attachment blocks 360 depicted in FIGS. 13–17. These receiving means or attachment blocks 560 include a base 506 and two parallel side plates 507 which support a pin 508 therebetween. Pin 508 is engagable by hooks of an attachment means as depicted for example in FIG. 13. In an alternative embodiment, the receiving means or attachment block 560 could be replaced by an eyelet similar to that depicted in FIG. 6. The base 506 of the receiving means or attachment block 560 includes through-bores 509 through which mechanical fasteners 502 can pass and be received in bores 505 of the surface-mount base plate 501. In an alternative embodiment, the surface-mount base plate 501 could include studs in place of bores 505. The receiving means or attachment block 560 could be secured to such studs by mechanical means such as nuts, pins, caps, etc.

Figure 21:
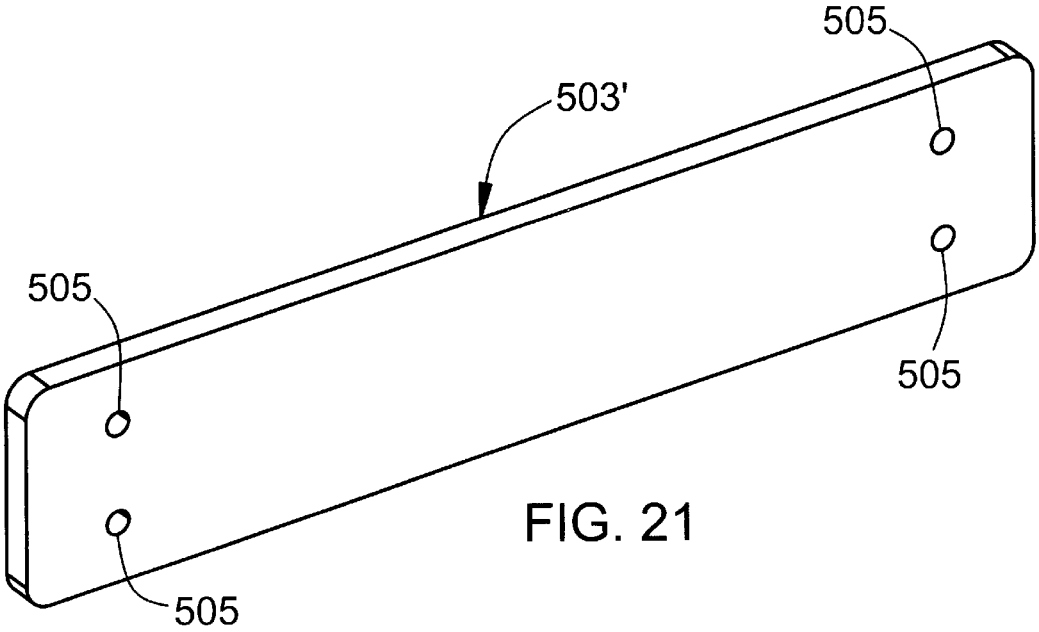
FIG. 21 is a perspective view of a surface-mount base plate that supports a pair of receiving means or attachment blocks.

FIG. 21 is a perspective view of a surface-mount base plate that supports a pair of receiving means or attachment blocks. The surface-mount base plate 501' of FIG. 21 includes a plurality of bores 505 in aligned positions for securing a plurality of receiving means or attaching blocks 560 to the surface-mount base plate 501'. The embodiment of the surface-mount base plate 501' depicted in FIG. 21 includes two pair of bores 505 and is designed to be used in conjunction with two receiving means or attaching blocks 560 (FIG. 20) which are spaced apart. The mounting surface 503' of surface-mount base plate 501' should be as smooth and flat as the mounting surface 503 of the surface-mount base plate 501 of FIG. 19. Sufficient smoothness and flatness can be achieved by conventional machining and polishing.

The surface-mount base plate(s) 501 is attached to a door, a mullion between two doors, a door frame and/or a wall adjacent a door by chemical means, such as adhesives, glues, cements, etc. A particularly suitable adhesive for use with glass and smooth mounting surfaces is Depend® ODC-Free 330 adhesive from Loctite Corp. (Rocky Hill, Conn.). This adhesive is best used in conjunction with an activator such as Activator 7387 which is also available from Loctite Corp.

The attachment block assembly 500 is attached to an appropriate support structure surface such as a door, a mullion between two doors, a door frame and/or a wall adjacent a door by applying an adhesive, glue, cement, etc. between the mounting surface of the surface-mount base plate(s) and the support structure surface. Once dried or cured, the adhesive, glue cement, etc. fixes the surface-mount base plate(s) to the support structure surface. Thereafter, the receiving means or attachment block(s) is secured to the surface-mount base plate(s) by suitable mechanical fasteners. The hook(s) of the attachment means of a security device according to the present invention is then attached to the receiving means or attachment block(s).

The attachment block assembly 500 of FIG. 18 can be used in a wide variety of configurations, including but not limited to any of the arrangements depicted in FIGS. 6, 8, 9, and 12–17. As understood, some of these arrangements will requires more than one attachment block assembly. The surface-mount base plate 501' of FIG. 21 can be used in arrangements which require two receiving means or attachment blocks 560 that are attached to a common support structure surface, including the arrangements depicted in FIGS. 6, 8, and 9.

From the preceding description of the illustrative embodiments of the invention, it is evident that the objects of the invention have been attained. Although this invention has been described and illustrated in detail, it is to be clearly understood that the same is by way of illustration and example only and is not to be taken by way of limitation. Therefore, the spirit and scope of this invention are to be limited only by the terms of the appended claims.

What is claimed is:

1. A security device in combination with an entry structure of a building, the combination comprising:

a support bar having first and second ends;

at least one blocking means disposed along the support bar;

attaching means mounted to the support bar for removably securing the support bar in position adjacent an entry structure, receiving means for engagement by the attaching means, the receiving means comprising a base plate and an attachment block, the base plate being surface mounted in an impenetrable manner to the entry structure by a chemical bonding means; and an actuator connected to the attaching means and operable to actuate the attaching means to secure the support bar adjacent the entry structure.

2. The combination of claim 1, wherein the entry structure includes a door and one of a frame to which the door is attached or a wall adjacent the door, the receiving means is surface mounted to one of the frame or the wall, and the at least one blocking means engages the door.

3. The combination of claim 1, wherein the entry structure comprises glass.

4. The combination of claim 1, wherein the chemical bonding means is selected from the group consisting of adhesives, glues, cements and mixtures thereof.

5. The combination of claim 1, wherein the base plate and the attachment block are connected together by a mechanical fastener.

6. The combination of claim 1, wherein the attaching means includes a first attaching mechanism at the first end of the support bar and a second attaching mechanism at the second end of the support bar and the receiving means includes a first receiving means for engagement by the first attaching mechanism and a second receiving means for engagement by the second attachment mechanism.

7. The combination of claim 6 wherein the first and second receiving means each include a surface-mount base plate and an attachment block.

8. The combination of claim 1, wherein the attaching means includes a first attaching mechanism at the first end of the support bar and a second attaching mechanism at the second end of the support bar and the receiving means includes a single surface-mount base plate and a first attachment block for engagement by the first attaching mechanism and a second attachment block for engagement by the second attachment mechanism.

9. The combination of claim 1, wherein the at least one blocking means comprises two blocking means which are located at the ends of the support bar.

10. The combination of claim 1, wherein the entry structure includes a pair of doors separated by a mullion, the receiving means is surface mounted to the doors, and the at least one blocking means engages the mullion to secure the support bar adjacent the doors.

11. The combination of claim 1, wherein the entry structure includes a door and one of a frame to which the door is attached or a wall adjacent the door, the receiving means is surface mounted to the door and one of the frame or the wall, and the at least one blocking means engages the door.

12. A security device for doors in combination with a door assembly which combination comprising:

a support bar having first and second ends;

at least one means mounted to the support bar for removably attaching the security device to a portion of the door assembly;

receiving means for engagement by the attachment means, the receiving means comprising a base plate and an attachment block, the base plate being surface-mounted in an impenetrable manner to the door assembly by a chemical bonding mean; and an actuator including a camming surface, which camming surface is engageable with a portion of the actuating mechanism for securing the security device in position with respect to the door assembly.

13. The combination of claim 12, wherein the attaching means includes a first attaching mechanism at the first end of the support bar and a second attaching mechanism at the second end of the support bar and the receiving means includes a first receiving means for engagement by the first attaching mechanism and a second receiving means for engagement by the second attachment mechanism.

14. The combination of claim 13 wherein the first and second receiving means each include a surface-mount base plate and an attachment block.

15. The combination of claim 12, wherein the attaching means includes a first attaching mechanism at the first end of the support bar and a second attaching mechanism at the second end of the support bar and the receiving means includes a single surface-mount base plate and a first attachment block for engagement by the first attaching mechanism and a second attachment block for engagement by the second attachment mechanism.

16. The combination of claim 12, wherein the at least one blocking means comprises two blocking means which are located at the ends of the support bar.

17. The combination of claim 12, wherein the chemical bonding means is selected from the group consisting of adhesives, glues, cements and mixtures thereof.

18. The combination of claim 12, wherein the base plate and the attachment block are connected together by a mechanical fastener.

* * * * *